United States Patent [19]

Voigt, Jr. et al.

[11] 3,937,771

[45] Feb. 10, 1976

[54] PROCESS FOR PREPARING MODIFIED BLACK POWDER PELLETS

[75] Inventors: H. William Voigt, Jr., Stanhope; Lawrence W. Pell, West Orange; Jean P. Picard, Morristown, all of N.J.

[73] Assignee: The United States of America as represented by the Secretary of the Army, Washington, D.C.

[22] Filed: Aug. 21, 1974

[21] Appl. No.: 499,248

[52] U.S. Cl. ..... 264/3 E

[51] Int. Cl.[2] ..... C60B 21/02

[58] Field of Search ..... 264/109, 117, 3 C, 3 E

[56] References Cited

UNITED STATES PATENTS 3,660,546 5/1972 Lovold ..... 264/3 C

*Primary Examiner*—Robert F. White
*Assistant Examiner*—J. R. Hall
*Attorney, Agent, or Firm*—Nathan Edelberg; Robert P. Gibson; A. Victor Erkkila

[57] ABSTRACT

Black powder pills of excellent ignition properties are obtained by a simplified process, wherein an aqueous solution of $KNO_3$ is introduced into an alcoholic medium, such as ethanol, in the presence of finely divided particles of sulfur and wood charcoal and/or carbon black and a small amount of a polyvinyl pyrrolidone, whereby the $KNO_3$ is precipitated in finely divided form in intimate mixture with the particles of sulfur and carbon. The resulting particulate mixture contains an extremely thin surface film of adsorbed polyvinyl pyrrolidone, and is separated from the liquid and dried. The modified black powder thus obtained can be safely handled in the dry state and compressed into pills possessing ignition properties equivalent to standard black powder granules. The novel process provides excellent particle size control and reproducibility and eliminates time consuming, hazardous steps and special apparatus used in the conventional commercial black powder process.

10 Claims, No Drawings

PROCESS FOR PREPARING MODIFIED BLACK POWDER PELLETS

BACKGROUND OF THE INVENTION

Black powder finds considerable use for ignition of smokeless powder, time fuzes, squibs, rocket propulsion units, etc. It is no longer employed as a military propellant. Standard black powder contains 74.0 ± 1% $KNO_3$, 15.6 ± 1% charcoal and 10.4 ± 1% sulfur.

In the manufacture of black powder, as conventionally practiced, charcoal and sulfur are pulverized together in a wheel mill, whereby some of the sulfur is incorporated into the pores of the charcoal. In view of the danger of explosion the potassium nitrate is ground separately in the wheel mill. The pulverized mixture of sulfur and charcoal is moistened, mixed with the nitrate and milled in a wheel mill, whereby the degree of incorporation is increased. The milled material is then pressed into cakes in a hydraulic press, and the cakes are broken up in a corning mill having adjustable rolls with corrugated surfaces, which reduce the material to the desired grain size. The product from the corning mill is screened to remove fines, which are returned to the wheel mill, and the coarse granules are passed through the corning mill a second time and then rescreened. The resulting granules are blended by tumbling in a rotating hardwood drum, wherein the powder is heated by friction to as much as 65°C. and any moisture is removed by evaporation. Since it is generally desired to glaze the powder, graphite is added to the contents of the drum before the powder is too dry. The dried powder is then screened into standard granulations.

Although the foregoing operations have optimized the manufacture of black powder, they are nonetheless time-consuming and hazardous, and require special types of apparatus. Recently, it has been proposed according to U.S. Pat. No. 3,660,546 to prepare meal black powder by simultaneously effecting the mixing, pulverizing and grinding of the sulfur, carbon and potassium nitrate by continuous introduction thereof into a jet mill, wherein air tangentially introduced under high pressure subdivides the particles by striking each other. The resulting powder is further processed by pressing into cakes, disintegration, screening, blending, etc., to produce standard black powder granules.

SUMMARY OF THE INVENTION

It is an object of the present invention to provide a simplified process for manufacturing a modified black powder, which provides excellent particle size control and reproducibility of results and avoids the time consuming and hazardous process steps and special apparatus associated with the conventional commercial process.

Another object is to provide a simplified process for manufacturing a modified black powder, which can be safely pressed into pellets having ballistic characteristics substantially equivalent to those of standard black powder granules.

A further object is to provide a simplified process for manufacturing a modified black powder, wherein part or all of the charcoal conventionally employed is replaced by an activated carbon black.

Other objects will become apparent as the invention is further described.

In accordance with the process of the present invention, the foregoing and other objects are obtained by mixing an aqueous solution of potassium nitrate with a liquid alcoholic medium, in which the $KNO_3$ is insoluble, in the presence of finely divided sulfur and carbon from the group consisting of wood charcoal and carbon black and mixtures thereof, and a small amount of a high molecular weight polyvinyl pyrrolidone, whereby the $KNO_3$ is precipitated in finely divided form in intimate mixture with the particles of sulfur and carbon. Preferably, the aqueous $KNO_3$ solution is introduced into a suspension of finely divided sulfur and charcoal and/or carbon black in the liquid alcoholic medium containing the polyvinyl pyrrolidone dissolved therein. The solid material is then separated from the liquid as by filtration, and dried. The dried material thus obtained is a uniform, readily frangible material of low bulk density consisting essentially of an intimate mixture of the finely divided $KNO_3$, sulfur and carbon ingredients containing a thin coating of the polyvinyl pyrrolidone. This material can be readily and safely pressed into strong pills and tablets of excellent ballistic properties which are substantially equal to those of standard black powder granules.

It was known to make a crude black powder approaching commercial powder in performance according to a field expediency procedure by introducing a hot solution of potassium nitrate containing a suspension of the sulfur and charcoal ingredients into alcohol, whereby the potassium nitrate was precipitated, after which the mixture was filtered and the damp cake was forced through a screen to form granules. The process produced powdery, frangible, low-density granules of insufficient bulk packing density even when a suggested binder such as starch was added. Also, the step of heating the potassium nitrate solution containing the slurried sulfur and charcoal ingredients presented a hazard, since the container walls were required to be kept moist to prevent formation of dry, explosible crust. Further, the amount of potassium nitrate in the final black powder varied excessively due to loss of potassium nitrate in the mother liquors (Thomas J. Hennesey, "Field Expedient Preparation of Black Powders", Frankford Arsenal Report M 67-16-1, February, 1967).

The process of the present invention, as illustrated in the examples, overcomes these deficiencies. Further, it produces a dried product, which due to the presence therein of polyvinyl pyrrolidone, can be safely processed and pressed into strong pills and tablets of black powder of controlled geometry and bulk density. Propellant ignition and burning rate characteristics can be varied by using the polyvinyl pyrrolidone and by controlling pill density. The black powder pills thus obtained possess excellent heat resistance and ignition properties, which can equal or even surpass those of standard DuPont black powder granules obtained by the conventional commercial black powder process previously described. In addition the present process eliminates the following process steps of the conventional commercial black powder process, including the special apparatus and hazards associated therewith:

a. wheel milling or jet milling
b. hydraulic pressing to form the cake
c. corning milling to break up the cake
d. graphite glazing and hot air drying Also, the novel process lends itself to making improved and specialized igniter powders to replace black powder.

DESCRIPTION OF THE PREFERRED EMBODIMENTS

In carrying out the process of this invention, the aqueous $KNO_3$ solution is preferably introduced into a suspension of the finely divided sulfur and carbon particles in the alcoholic precipitating medium containing a small amount of dissolved polyvinyl pyrrolidone. Generally, it is necessary to employ a heated aqueous solution of $KNO_3$ to obtain the concentrated solutions desirable for use in the present process. It has been unexpectedly found that a precipitated $KNO_3$ of substantially finer particle size can be obtained by introducing the concentrated $KNO_3$ solution into the alcoholic precipitation medium precooled to below ambient temperatures, e.g. 15°C. and below. The finer particle size promotes a more intimate incorporation of the potassium nitrate with the other ingredients and produces a black powder pellet exhibiting faster ignition properties. Also, it has been found that by introducing the $KNO_3$ solution into the alcoholic medium containing the sulfur and carbon as well as polyvinyl pyrrolidone, a smaller amount of $KNO_3$ is lost in the mother liquors than when the sulfur and carbon are incorporated in the $KNO_3$ solution.

The use of polyvinyl pyrrolidone according to the present invention provides a number of important and unobvious advantages. Thus, the polyvinyl pyrrolidone, although soluble in water and alcoholic solution, is substantive to the black powder, i.e. it is adsorbed from solution onto the surfaces of black powder particles as an extremely thin film or coating. This barrier coating of the oxidizer ($KNO_3$) and the fuel components (sulfur and carbon) appears to prevent direct contact between the oxidizer and fuel particles, thereby reducing the hazard of processing the black powder without adversely affecting the burning properties of the black powder produced. Further, the presence of polyvinyl pyrrolidone in the alcoholic solution promotes the suspension and thorough blending of the finely divided sulfur, carbon and precipitated potassium nitrate black powder ingredients (which is difficult due to their different densities), thereby insuring the production of a dry homogeneous product, which can be pressed into pills or tablets of excellent mechanical strength and burning properties. Also, the polyvinyl pyrrolidone reduces the sensitivity of the black powder to friction and impact, thereby obviating the need for addition of moisture during processing thereof, as required in the steps of the conventional process; and the final pellets or pills of black powder produced according to the present invention are strong and less sensitive to friction and impact than the granules produced by the conventional process. Suitable polyvinyl pyrrolidones for use in the present process may vary widely in molecular weight and include products having an average molecular weight of from 40,000 to 360,000 by the osmometric method (J. Polymer Sci 10, 371 (1953)). The amount of polyvinyl pyrrolidone required is small and amounts between about 0.1 and 0.5 weight percent based on the black powder are generally suitable.

The sulfur and carbon ingredients should be finely divided for use in the process of the present invention. In the preferred embodiment of the present invention, the sulfur ingredient has an average particle size not exceeding about 10 microns (u); and as to the carbon ingredient, the wood charcoal, e.g. derived from alder and willow, has an average particle size not exceeding about 50 microns in largest dimension, while the carbon black has an average particle diameter not exceeding about 100 millimicrons (mu) and a surface area not less than about 20 square meters per gram (by N adsorption B.E.T.) An especially preferred class of carbon blacks for use in the present invention is characterized by possessing an average particle diameter between about 10 and 50 millimicrons, a surface area between about 100 and 1000 square meters per gram and a moisture-free volatile matter content of between about 3% and 20% (by ASTM-D1620-60). Carbon blacks of the foregoing physical characteristics are available commercially and can be obtained by the incomplete combustion of gaseous or liquid hydrocarbons, e.g. channel black and furnace black. By replacing part of the wood charcoal with a carbon black, a superior black powder product possessing less moisture pickup or hygroscopicity is produced; and the black powder pellets obtained thereby are more readily consolidated, i.e. require less pressure and dwell time in the mold, thereby allowing increased production rate and product quality. In general, mixtures of about 1/3 to 3 parts by weight of carbon black per part of wood charcoal are preferred for use as the carbon ingredient in the present invention.

The following examples illustrate specific embodiments of the process of the present invention.

EXAMPLE 1

45 Grams of $KNO_3$ prills were dissolved in 45 ml. of water at about 75°C. 2.5 Grams of $KNO_3$ were added to compensate for loss thereof in the filtrate — see below.

6.24 Grams of commercial flowers of sulfur (particle size ca 3–4 u) and 8.76 grams of activated carbon black marketed as Peerless 155 Carbon Black Powder by Cities Service Company, Columbian Division, Akron, Ohio, having a particle diameter (arithmetic mean) of 22 mu, a moisture free volatile matter content of 3.9% and surface area of 130 sq. meters per gram by N adsorption (B.E.T.), were suspended with vigorous agitation in a solution of 0.135 gram of polyvinyl pyrrolidone mol. wt. 90,000 and 0.6 gram of mercaptan terminated polyacrylic liquid polymer, having a Brookfield viscosity at 27°C. of 17,200 cps., 1.90% mercaptan content and 3,000 molecular weight, marketed as Hycar MTA by B. F. Goodrich Co., in 135 ml. of 95% ethanol.

The alcoholic suspension of the fuel components was cooled to 15°C., after which the hot aqueous $KNO_3$ solution was introduced gradually with vigorous agitation, whereby the $KNO_3$ was precipitated in the form of very fine particles intimately mixed with the fuel components. The resulting mixture, which had a temperature of 35°C., was filtered through a Buchner funnel and the filter cake was washed twice with 30 ml. portions of 95% ethanol and dried on a tray at 65°C. The filtrate when evaporated to dryness yielded 2.4 grams of $KNO_3$, corresponding to 4% by weight of the black powder mixture obtained, which is a substantially smaller loss of $KNO_3$ in the filtrate than by the Hennesey procedure noted previously. The dry black powder thus obtained weighed 59.4 grams and was a uniform, frangible product of 0.52 gram/cc. apparent density. The product was pressed under 60,000 psi. into ¼ × ¼ inch cylindrical pellets of 1.78 grams/cc. density.

EXAMPLE 2

Same as example 1 except that mercaptan terminated acrylate liquid polymer was omitted and the carbon source consisted of a channel carbon black marketed as Superba Carbon Black Powder by Cities Service Company, Columbian Division, Akron, Ohio, having a particle diameter (arithmetic mean) of 14 mu, a moisture-free volatile matter content of 10.5%, and surface area of 695 sq. meters per gram by N adsorption (B.E.T.)

EXAMPLE 3

Same as example 2 except that wood charcoal, having needle like particles of about 6 u diameter and 6–25 u length, was employed in place of the Superba Carbon Black Powder. The wood charcoal employed was obtained by ballmilling commercial wood charcoal marketed under the tradename "Cascade" by Shawinigan Chemicals Co., Canada.

EXAMPLE 4

Same as example 3 except that colloidal sulfur, particle size of about 1 u (obtained by introducing a solution of sulfur in N-methyl-2-pyrrolidone solvent into water, separating the fine flocculent precipitate thus obtained by filtration, washing the precipitate with ethanol and drying) was used in place of the flowers of sulfur.

EXAMPLE 5

Same as example 2 except that Molacco Carbon Black Powder, sold by Cities Service Co., Columbian Div., having a particle diameter of 62 mu, a surface area of 23 square meters per gram by N adsorption (B.E.T.) and a moisture-free volatile matter content of 0.3% was employed in place of the Peerless 155 Carbon Black.

EXAMPLE 6

Same as example 1 except that the carbon source consists of a 50/50 mixture by weight of Molacco Carbon Black Powder, as described in example 5 and ballmilled wood charcoal, as described in example 3.

The pellets thus obtained, as well as standard DuPont Class 1 black powder granules made by the conventional process noted above and pellets made by pressing pulverized Class 1 black powder granules into pellets of the aforedescribed size and density were tested according to the standard closed bomb test to determine the delay time to develop 60 psi. pressure.

| Black Powder | Closed Bomb Test* Delay Time to 60 psi. |
|---|---|
| DuPont Class 1 granules | 26 m secs |
| DuPont Class 1 pellets | 32 |
| Example 1 | 27 |
| Example 2 | 26 |
| Example 3 | 26 |
| Example 4 | 24 |
| Example 5 | 39 |
| Example 6 | 26 |

*Described in U.S. Army Picatinny Arsenal Technical Report 2005, "Method of Calculation of Interior Ballistic Properties of Propellants from Closed Bomb Data", Arnold O. Pallingston and Murray Weinstein, June 1954.

The table shows that according to the closed bomb test, black powder pellets made by the process of the present invention from wood charcoal and carbon blacks of the especially preferred class noted above are essentially equal to the standard DuPont Class 1 granules, and markedly superior to corresponding pellets obtained in example 5 with Molacco Carbon Black having a much larger particle size, smaller surface area and volatile content. However, even when carbon blacks, such as Molacco Carbon Black, having larger particle size, smaller surface area and/or lower moisture-free volatile content than carbon blacks of the aforesaid especially preferred class, are employed, it is possible to obtain black powder pellets exhibiting reduced delay times by mixing such carbon blacks with finely divided wood charcoal (example 6), and/or with a small amount, e.g. 0.1 to 5% based on the weight of the black powder, of a mercaptan terminated polyacrylic liquid polymer or a mercaptan terminated polybutadiene liquid polymer, or another additive known to increase the ignition rate of black powder, e.g. $Pb_3O_4$ or resorcinol.

The foregoing disclosure is merely illustrative of the principles of this invention and are not to be interpreted in a limiting sense. We wish it to be understood that we do not desire to be limited to exact details of construction shown and described, because obvious modifications will occur to a person skilled in the art.

What is claimed is:

1. A process for preparing black powder pellets consisting essentially of potassium nitrate, sulfur and carbon, which comprises:

dissolving the potassium nitrate in water, mixing the aqueous potassium nitrate solution with an alcoholic precipitating medium, the aqueous potassium nitrate solution and the alcoholic medium being such that the potassium nitrate is essentially insoluble in the resulting mixture and precipitates therefrom in particulate form, incorporating in the aqueous potassium nitrate solution or the alcoholic medium prior to the mixing step, the sulfur having an average particle size not greater than about 10 microns, the carbon selected from the group consisting of wood charcoal having an average particle size not greater than about 50 microns in longest dimension, and carbon black having an average particle size not exceeding about 100 millimicrons and a surface area not less than about 20 square meters per gram, and mixtures thereof, and a small amount of a polyvinyl pyrrolidone, separating the resulting particulate mixture of potassium nitrate, sulfur and carbon containing polyvinyl pyrrolidone from said resulting mixture, drying the particulate mixture, and pressing the dry particulate black powder mixture into pellets.

2. The process of claim 1, wherein the sulfur, carbon and polyvinyl pyrrolidone are incorporated in the alcoholic medium and the aqueous potassium nitrate solution is introduced into the alcoholic medium containing the sulfur, carbon and polyvinyl pyrrolidone.

3. The process of claim 2, wherein the aqueous potassium nitrate solution contains about equal weights of potassium nitrate and water and the alcoholic medium consists essentially of ethanol, such that the resulting mixture contains not more than about 0.4 part by weight of water per part of ethanol.

4. The process of claim 1, wherein the alcoholic medium comprises ethanol.

5. The process of claim 1, wherein the alcoholic medium comprises 2-propanol.

6. The process of claim 1, wherein the carbon black has an average diameter between about 10 and 50 millimicrons, a surface area between about 100 and 1000 square meters per gram and a moisture-free volatile matter content of between about 3 and 20%.

7. The process of claim 1, wherein the polyvinyl pyrrolidone is present in amounts between about 0.1% and 0.5% based on the combined weight of the potassium nitrate, sulfur and carbon.

8. The process of claim 1, wherein the carbon is a mixture of ⅓ to 3 parts of carbon black per part of wood charcoal.

9. The process of claim 1, wherein 0.1% to 5% of a mercaptan terminated acrylic liquid polymer, based on the combined weight of the potassium nitrate, sulfur and carbon, is present in the alcoholic medium.

10. The process of claim 1, wherein the polyvinyl pyrrolidone has an average molecular weight of from 40,000 to 360,000.

* * * * *